US010347405B2

(12) United States Patent
Herzer et al.

(10) Patent No.: US 10,347,405 B2
(45) Date of Patent: Jul. 9, 2019

(54) ALLOY, MAGNET CORE AND METHOD FOR PRODUCING A STRIP FROM AN ALLOY

(71) Applicant: Vacuumschmelze GmbH & Co. KG, Hanau (DE)

(72) Inventors: Giselher Herzer, Bruchköbel (DE); Mie Marsilius, Klein-Auheim (DE); Christian Polak, Blankenbach (DE)

(73) Assignee: VACUUMSCHMELZE GMBH & CO. KG. (DE)

( * ) Notice: Subject to any disclaimer, the term of this patent is extended or adjusted under 35 U.S.C. 154(b) by 608 days.

(21) Appl. No.: 14/052,368

(22) Filed: Oct. 11, 2013

(65) Prior Publication Data

US 2014/0104024 A1 Apr. 17, 2014

(30) Foreign Application Priority Data

Oct. 12, 2012 (DE) ..... 10 2012 109 744

(51) Int. Cl.
*H01F 1/047* (2006.01)
*H01F 41/02* (2006.01)
(Continued)

(52) U.S. Cl.
CPC ..... *H01F 1/047* (2013.01); *C22C 33/003* (2013.01); *C22C 38/002* (2013.01); *C22C 38/02* (2013.01);
(Continued)

(58) Field of Classification Search
CPC ..... C22C 33/00; H01F 1/047; H01F 41/02
(Continued)

(56) References Cited

U.S. PATENT DOCUMENTS 5,096,510 A * 3/1992 Schoen ..... C21D 8/125 148/111
5,611,871 A 3/1997 Yoshizawa et al.
(Continued)

FOREIGN PATENT DOCUMENTS

EP 0 271 657 A2 6/1988
EP 0299298 B1 * 7/1988 ..... H01F 27/24
EP 1 724 792 A1 11/2006

OTHER PUBLICATIONS

Search Report dated Jun. 27, 2013, by the German Patent Office for Application No. 10 2012 109 744.5.

*Primary Examiner* — Jie Yang
(74) *Attorney, Agent, or Firm* — Dickinson Wright PLLC

(57) ABSTRACT

An alloy of $Fe_{100-a-b-c-d-x-y-z}Cu_aNb_bM_cT_dSi_xB_yZ_z$ and up to 1 atomic % impurities; M is one or more of Mo or Ta, T is one or more of V, Cr, Co or Ni and Z is one or more of C, P or Ge, wherein 0.0 atomic %≤a<1.5 atomic %, 0.0 atomic %≤b<3.0 atomic %, 0.2 atomic %≤c≤4.0 atomic %, 0.0 atomic %≤d<5.0 atomic %, 12.0 atomic %<x<18.0 atomic %, 5.0 atomic %<y<12.0 atomic % and 0.0 atomic %≤z<2.0 atomic %, and wherein 2.0 atomic %≤(b+c)≤4.0 atomic %, produced in the form of a strip and having a nanocrystalline structure in which at least 50% by volume of the grains have an average size of less than 100 nm, a remanence ratio $J_r/J_s$<0.02, $J_r$ being the remanent polarization and $J_s$ being the saturation polarization, and a coercitive field strength $H_c$ which is less than 1% of the anisotropic field strength $H_a$ and/or less than 10 A/m.

29 Claims, 4 Drawing Sheets

(51) Int. Cl.

| | |
|---|---|
| ***H01F 1/153*** | (2006.01) |
| ***C22C 33/00*** | (2006.01) |
| ***C22C 38/00*** | (2006.01) |
| ***C22C 38/02*** | (2006.01) |
| ***C22C 38/12*** | (2006.01) |
| ***C22C 38/16*** | (2006.01) |
| ***C22C 45/02*** | (2006.01) |

(52) U.S. Cl.
CPC ..... *C22C 38/12* (2013.01); *C22C 38/16* (2013.01); *C22C 45/02* (2013.01); *H01F 1/15333* (2013.01); *H01F 41/02* (2013.01)

(58) Field of Classification Search
USPC ..... 148/304, 121
See application file for complete search history.

(56) References Cited

U.S. PATENT DOCUMENTS

| | | | | |
|---|---|---|---|---|
| 7,583,173 | B2 | 9/2009 | Waeckerle et al. | |
| 2008/0196795 | A1 | 8/2008 | Waeckerle et al. | |
| 2012/0262266 | A1* | 10/2012 | Herzer ..... | C22C 38/00 336/233 |

* cited by examiner

ALLOY, MAGNET CORE AND METHOD FOR PRODUCING A STRIP FROM AN ALLOY

This application claims benefit under 35 U.S.C. § 119 of the filing date of DE 10 2012 109 744.5, filed Oct. 12, 2012, the entire contents of which are incorporated by reference herein for all purposes.

BACKGROUND

1. Field

Disclosed herein is an alloy, in particular a soft magnetic alloy, which is suitable for use as a magnet core, to a magnet core and to a method for producing a strip from an alloy.

2. Description of Related Art

Nanocrystalline alloys based on a composition consisting of $Fe_{100-a-b-c-d-x-y-z}Cu_aNb_bM_cT_dSi_xB_yZ_z$ can be used as magnet cores in various applications. U.S. Pat. No. 7,583,173 discloses a wound magnet core which is used, among other applications, in a current transformer consisting of $(Fe_{1-a}Ni_a)_{100-x-y-z-a-b-c}Cu_xSi_yB_zNb_\alpha M'_\beta M''_\gamma$, wherein $a \leq 0.3$, $0.6 \leq x \leq 1.5$, $10 \leq y \leq 17$, $5 \leq z \leq 14$, $2 \leq \alpha \leq 6$, $\beta \leq 7$, $\gamma \leq 8$, M' is one or more of the elements V, Cr, Al and Zn and M" is one or more of the elements C, Ge, P, Ga, Sb, In and Be.

EP 0 271 657 A2 likewise discloses alloys with a composition on this basis.

In applications for magnet cores, low production costs are generally desirable. Any reduction in costs, however, should have little, if any consequences for the magnetic properties of the magnet core.

SUMMARY

There remains a need, therefore, to provide an alloy which has magnetic properties suitable for use as magnet cores and which can be produced cost-effectively.

This problem is solved by one or more of the embodiments disclosed herein.

Disclosed herein is an alloy consisting of $Fe_{100-a-b-c-d-x-y-z}Cu_aNb_bM_cT_dSi_xB_yZ_z$ and up to 1 atomic % impurities. M is one or more of the elements Mo or Ta, T is one or more of the elements V, Cr, Co or Ni and Z is one or more of the elements C, P or Ge, wherein 0.0 atomic $\% \leq a \leq 1.5$ atomic %, 0.0 atomic $\% \leq b < 3.0$ atomic %, 0.2 atomic $\% \leq c \leq 4.0$ atomic %, 0.0 atomic $\% \leq d < 5.0$ atomic %, 12.0 atomic $\% < x < 18.0$ atomic %, 5.0 atomic $\% < y < 12.0$ atomic % and 0.0 atomic $\% \leq z < 2.0$ atomic %. The sum of the elements Nb, Mo and Ta (b+c) is 2.0 atomic % (b+c) 4.0 atomic %. The alloy is provided in the form of a strip and has a nanocrystalline structure, at least 50% by volume of the grains having an average size of less than 100 nm. The alloy further has a remanence ratio $J_r/J_s < 0.02$, $J_r$ being the remanent polarisation and $J_s$ being the saturation polarisation, and a coercitive field strength $H_c$ which is less than 1% of the anisotropic field strength $H_a$ and/or less than 10 A/m.

The alloy thus has a composition with a niobium content of less than 3 atomic % as well as Mo and/or Ta, the total content of Nb and/or Mo and/or Ta lying between 2 atomic % and 4 atomic %. This composition offers the advantage that raw material costs are lower than when using a composition with a higher niobium content, for niobium is a relatively expensive element. Furthermore, owing to the Mo and/or Ta content, the coercitive field strength is kept relatively low.

An increased coercitive field strength results in higher hysteresis losses, which have a negative effect on remagnetisation losses in the low-frequency range.

As a result, the low coercitive field strength combined with low raw materials costs as made available by the alloy according to the invention is advantageous in low-frequency applications.

The lower limit of the silicon content and the upper limit of the boron content of the alloy are specified such that the alloy can be produced in form of a strip using tension in a continuous furnace, whereby the magnetic properties mentioned above are obtained. This being so, the alloy can, using this production method, be produced with the desired magnetic properties for magnet core applications despite its low niobium content.

The form of a strip not only allows the alloy to be produced under tension in a continuous furnace, but also the production of a magnet core with any number of windings. As a result, the size and the magnetic properties of the magnet core can easily be adapted to a specific application by choosing suitable windings. The nanocrystalline structure with a grain size of less than 100 nm in at least 50 percent by volume of the alloy results in a low saturation magnetostriction at a high saturation polarisation. With a suitable alloy selection, the heat treatment under tension results in a remanence ratio of less than 0.02 and a coercitive field strength $H_c$ which amounts to less than 1% of the anisotropic field strength $H_a$ and/or less than 10 A/m, preferably less than 5 A/m.

In further embodiments, the alloy has a magnetic hysteresis loop with a central linear section. The central section of the hysteresis loop is defined as the section of the hysteresis loop which lies between the anisotropic field strength points which indicate the transition into saturation.

A linear section of this central part of the hysteresis loop is herein described using a non-linearity factor NL, which is calculated as follows:

$$NL = \frac{100}{2}(\delta J_{auf} + \delta J_{ab})/J_s$$

wherein $\delta J_{auf}$ is the standard deviation of the magnetic polarisation from a regression line through the ascending branch of the hysteresis loop between polarisation values of ±75% of the saturation polarisation $J_s$ and $\delta J_{ab}$ is the standard deviation of the magnetic polarisation from a regression line through the descending branch of the hysteresis loop between polarisation values of ±75% of the saturation polarisation $J_s$.

In one embodiment, the alloy has a hysteresis loop with a non-linearity factor NL, wherein NL<0.5%.

This alloy is therefore particularly suitable for a magnet core having a reduced size and a lower weight and, while involving low raw material costs, nevertheless having the desired soft magnetic properties for use as a magnet core.

In one embodiment, the remanence ratio of the alloy is less than 0.01. The hysteresis loop of the alloy is therefore even more linear or even flatter.

In one embodiment, the alloy further has a permeability μ between 200 and 4000 or an anisotropic field strength $H_a$ in the range between 250 A/m and 4000 A/m. The permeability or the anisotropic field strength can primarily be determined by choosing an appropriate tension in the heat treatment process, the anisotropic field strength being proportional to the applied tension and the permeability being inversely proportional to the applied tension. In this embodiment, the tension lies in a range between approximately 10 MPa ($\mu$~4000, $H_a$~250 A/m) and approximately 250 MPa ($\mu$~200, $H_a$~5000 A/m). In one embodiment, the coercitive field strength has a value of less than 8 A/m even at these high anisotropic field strengths.

The limits mentioned for permeability and anisotropic field strength are indicated by way of example and should not be understood as restrictive. By reducing the tension to approximately 5 MPa, maximum permeabilities (minimum anisotropic field strengths) up to $\mu$~10000 ($H_a$~100 A/m) can be set, while minimum permeabilities (maximum anisotropic field strengths) up to $\mu$~50 ($H_a$~20000 A/m) can be set by increasing the tension.

The lower the permeability, the higher currents can flow through the windings of the magnetic core without saturating the material. Furthermore, at the same permeability values these currents can be the higher the higher the saturation polarisation $J_s$ of the material is. On the other hand, the inductance of the magnet core increases with its permeability and size. In order to build magnet cores combining a high inductance with a high current tolerance, it is therefore advantageous to use alloys having a higher saturation polarisation. In one embodiment, the saturation polarisation $J_s$=1.22 T at a coercitive field strength of less than 8 A/m, preferably less than 5 A/m. This can eventually be used without reducing the size and the weight of the core.

The alloy can have a saturation magnetostriction of less than 1 ppm. Alloys with a saturation magnetostriction below these limit values have particularly good magnetic properties even at internal tension. For higher permeability values, it is advantageous to select alloys with lower saturation magnetostriction values.

In one embodiment, the alloy does not contain any niobium, i.e. b=0. This embodiment offers the advantage that raw material costs are reduced further, because the niobium element has been omitted completely.

In a further embodiment, the alloy does not contain any copper, i.e. a=0. In another embodiment, the alloy does not contain any niobium or copper, i.e. a=0 and b=0.

In a further embodiment, the alloy contains both niobium and copper, wherein 0 atomic %<a≤0.5 atomic % and 0 atomic %<b≤0.5 atomic %.

In one embodiment, 0<b≤2 and 2 atomic %≤(b+c)≤4 atomic %, so that, in addition to niobium, the alloy contains molybdenum and/or tantalum as well.

In a further embodiment, the alloy does not contain any molybdenum and the minimum tantalum content is 0.2 atomic %, and the minimum niobium content is 1.8 atomic %. In one embodiment, the alloy does not contain any niobium or molybdenum, having a tantalum content between 2 atomic % and 4 atomic %.

In a further embodiment, the alloy does not contain any tantalum, and the minimum molybdenum content is 0.2 atomic % and the minimum niobium content is 1.8 atomic %, or the minimum molybdenum content is 0.7 atomic % and the minimum niobium content is 1.3 atomic %, or the minimum molybdenum content is 1.0 atomic % and the minimum niobium content is 1.0 atomic %. In one embodiment, the alloy does not contain any niobium or tantalum, having a molybdenum content between 2 atomic % and 4 atomic %.

In a further embodiment, the alloy does not contain any niobium and comprises a combination of molybdenum and tantalum. In a further embodiment, the alloy contains niobium, molybdenum and tantalum.

The total niobium, molybdenum and tantalum content (b+c) is 2 atomic %≤(b+c)≤4 atomic %. In further embodiments, the total niobium, molybdenum and tantalum content is 2.0 atomic %≤(b+c)<4.0 atomic % or 2.1 atomic %≤(b+c)≤3.0 atomic %.

In one embodiment, the upper limit of the content of the elements V, Cr, Co and/or Ni is restricted to 0.0 atomic %≤d<2.0 atomic %.

In one embodiment, the silicon content and the boron content are defined more closely, being 14.0 atomic %<x<17.0 atomic % and 5.5 atomic %<y<8.0 atomic % respectively.

As mentioned above, the alloy is produced in the form of a strip. This strip can generally have a thickness of 10 μm to 50 μm. Both with very thin strip and with very thick strip, there is an increased risk of tearing. The surface roughness can in strips of a thickness of less than approximately 17-19 μm result in holes, where the strip can easily tear when subjected to tension in the heat treatment process. At strip thickness values above 24-25 μm, the parent material may have local brittle areas where the strip tears. For this reason, the alloys referred to should preferably be given a strip thickness in the range of 18-22 μm. A particularly suitable strip should not have any holes and should be as smooth as possible, i.e. if possible have an average roughness $R_a$ of less than 1 μm. The strip width can be between 0.5 mm and 100 mm. The probability of tearing during the heat treatment process, due to a notch effect, is however greatly reduced as the strip becomes narrower. This being so, strip widths of less than 30 mm, or even better less than 15 mm, should preferably be used. For the illustrated embodiments, strips with a width of 6 mm and 10 mm were chosen. The average strip thickness was approximately 18-22 μm. In this context, it should be noted that the width and the thickness of the strip are, during the heat treatment process under tension, reduced in proportion to the tension applied. The width and the thickness of the strip are relatively reduced by 2-3% each per 100 MPa tension applied.

In a further embodiment, at least 70 percent by volume of the grains have an average size of less than 50 nm. This makes a further improvement of the magnetic properties possible.

The alloy, in the form of a strip, is heat-treated under tension in order to obtain the desired magnetic properties. The alloy, i.e. the finished heat-treated strip, is therefore characterised by a structure which has been produced by this production method. In one embodiment, the crystallites have an average size of approximately 20-25 nm and a residual elongation between approximately 0.02% and 0.5%, which is proportional to the tension applied in the heat treatment process. A heat treatment under a tension of 100 MPa, for example, results in an elongation of approximately 0.1%.

The magnetic properties of the alloy are influenced by the heat treatment parameters. In one embodiment, the strip is heat-treated in a continuous process at an annealing temperature between 450° C. and 750° C. under a tension of 10 MPa to 250 MPa with a dwell time of 2 seconds to 2 minutes. These temperatures, tensions and dwell times make it possible to obtain the desired magnetic properties for the alloy with a niobium content of less than 2 atomic %, a molybdenum and/or tantalum content of 0.2 atomic % to 4 atomic % and a total content of Nb, Mo and Ta of 2.0 atomic % to 4.0 atomic %.

A magnet core made from an alloy according to any of the above embodiments is also provided. The magnet core can have the form of a wound strip, and to form the magnet core, the strip can be wound in one plane or as a solenoid about a longitudinal axis, depending on application.

The strip of the magnet core can additionally be coated with an insulating layer to isolate the windings of the magnet core electrically from one another. This layer can for example be a polymer layer or a ceramic layer. The strip can be coated with the insulating layer before and/or after being wound into a magnet core. This insulating layer is optional, however.

In further embodiments, the strip has a natural insulating layer. As soon as in the production process of the strip, but also in the heat treatment process, a thin oxide layer, for example of silicon oxides, having a thickness of a few atomic layers can form, which provides enough insulation of the strip layers for many applications.

The magnet core according to one of the above embodiments can be used in various components. A power transformer, a current transformer and a storage choke with a magnet core according to any of these embodiments are also provided.

A method for producing a strip is also provided, the method comprising the following steps: A strip is provided from an amorphous alloy having a composition consisting of $Fe_{100-a-b-c-d-x-y-z}Cu_aNb_bM_cT_dSi_xB_yZ_z$ and up to one atomic % impurities, wherein M is one or more of the elements Mo or Ta, T is one or more of the elements V, Cr, Co or Ni and Z is one or more of the elements C, P or Ge, and wherein 0.0 atomic %≤a<1.5 atomic %, 0.0 atomic %≤b<3.0 atomic %, 0.2 atomic %≤c≤4.0 atomic %, 0.0 atomic %≤d<5.0 atomic %, 12.0 atomic %<x<18.0 atomic %, 5.0 atomic %<y<12.0 atomic % and 0.0 atomic %≤z<2.0 atomic % and 2 atomic %≤(b+c)≤4 atomic %. The strip is heat-treated under tension at a temperature of 450° C. to 750° C. to produce suitable magnetic properties for use as a magnet core.

The heat treatment results in the formation of a nanocrystalline structure with at least 50% by volume of the grains having an average size of less than 100 nm. Using this method, the composition can in particular be produced with a niobium content of less than 3 atomic % or less than 2 atomic % as well as 0.2 atomic % to 4 atomic % molybdenum and/or tantalum in such a way that it has a remanence ratio $J_r/J_s<0.02$, $J_r$ being the remanent polarisation and $J_s$ being the saturation polarisation, and a coercitive field strength $H_c$ which is less than 1% of the anisotropic field strength $H_a$ and/or less than 10 A/m.

The strip is heat-treated in a continuous process, for example in a continuous furnace. The strip is pulled through the continuous furnace at a speed s. This speed s can be adjusted such that a dwell time of the strip in a temperature zone of the continuous furnace which has a temperature within 5% of the temperature T lies between 2 seconds and 2 minutes. The time required for heating the strip to the temperature T is comparable to the duration of the heat treatment itself. The same applies to the duration of the following cooling process. In this annealing temperature range, this dwell time results in the desired structure and the desired magnetic properties.

In one embodiment, the strip is pulled through the continuous furnace under a tension between 5 MPa and 1000 MPa. This tension range is suitable for producing the desired magnetic properties in the above compositions.

In further embodiments, the strip is heat-treated in the continuous furnace under a tension of 10 MPa to 250 MPa or under a tension of 250 MPa to 1000 MPa.

This tension range determines the permeability range. Tensions between 5 MPa and 1000 MPa give permeability values between 40 and 10000. Tensions of 10 MPa to 250 MPa give permeability values in the range of 200 to 4000. Tensions above 250 to approximately 1000 MPa can also be used, resulting in flat loops with permeability values in the range of approximately μ~50 to ~200, which are particularly desirable for storage chokes.

The desired magnetic properties can also be dependent on the annealing temperature T and can therefore be adjusted by selecting the annealing temperature. In one embodiment, the temperature T is selected as a function of the niobium content in accordance with the relation ($T_{x1}$+50° C.) T ($T_{x2}$+30° C.). In this relation, $T_{x1}$ and $T_{x2}$ are the crystallisation temperatures defined by the maximum of the transition heat, which are determined using thermal standard methods, such as DSC (differential scanning calorimetry) at a heating rate of 10 K/min.

In a further embodiment, a desired value of the anisotropic field strength $H_a$ or the permeability and/or a maximum value of a remanence ratio $J_r/J_s$ of less than 0.02 and/or a maximum values of a coercitive field strength $H_c$ which is less than 1% of the anisotropic field strength $H_a$ and/or less than 10 A/m, as well as a permitted deviation range for each of these values, are predetermined.

To achieve this (these) value(s) along the length of the strip, the magnetic properties of the strip are continuously measured as it leaves the continuous furnace. If deviations outside the permitted range of magnetic properties are detected, the tension applied to the strip is adjusted accordingly in order to bring the measured values of the magnetic properties within the permitted deviation range.

This embodiment reduces the deviations of the magnetic properties along the length of the strip, so that the magnetic properties within a magnet core are more homogeneous and/or the magnetic properties of several magnet cores made from a single strip deviate less from one another. In this way, the uniformity of the soft magnetic properties of the magnet cores can be improved, in particular in commercial production.

BRIEF DESCRIPTION OF DRAWINGS

Embodiments will now be explained in greater detail with reference to the following examples, tables and drawings.

Figure 1:
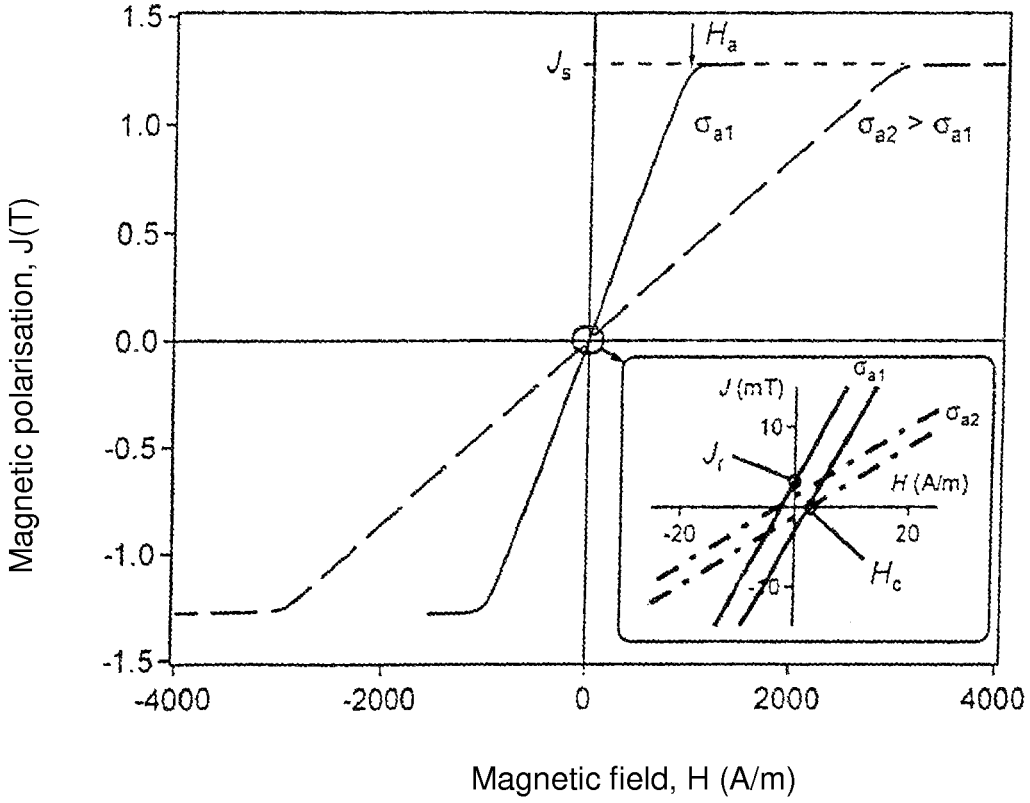
FIG. 1 shows the hysteresis loops of an alloy according to the invention which is heat-treated under two different tensions.

Table 1 lists the magnetic properties for various alloys according to the invention and for comparative examples, Table 2 shows further alloy examples and their magnetic properties, and Table 3 lists crystallisation temperatures $T_{x1}$ and $T_{x2}$ (DSC 10 K/min, peak) and annealing temperatures T for three alloys from Table 1.

DETAILED DESCRIPTION OF SPECIFIC EMBODIMENTS

Various alloys based on $Fe_{100-a-b-c-d-x-y-z}Cu_aNb_bM_cT_dSi_xB_yZ_z$ are produced in the form of an amorphous strip. Typical strips have a width of 6 mm to 10 mm and a thickness of 17 μm to 25 μm. The amorphous strip can for example be produced in the desired composition by means of a rapid solidification technology. These amorphous strips are then heat-treated to produce a nanocrystalline structure and the desired magnetic properties.

In alloys based on $Fe_{100-a-b-c-d-x-y-z}Cu_aNb_bM_cT_dSi_xB_yZ_z$, the reduction of the Nb content is desirable in order to reduce raw material costs without at the same time increasing the coercitive field strength too much. Below, it is disclosed that this can be achieved by wholly or partially replacing Nb by Mo or Ta, wherein the total content of the elements from the Nb and/or Mo and/or Ta group(s) is at least 2 atomic % and the niobium content is less than 3 atomic % or less than 2 atomic %.

Table 1 shows the saturation polarisation $J_s$ as measured in the production state and the values for saturation magnetostriction λs, nonlinearity NL, remanence ratio $J_r/J_s$, coercitive field strength $H_c$, anisotropic field strength $H_a$ and relative permeability μ as measured after heat treatment under a tension of 50±10 MPa for various alloy compositions. Composition data are given in atomic percent.

The heat treatment was performed under a tension of 50±10 MPa for a duration of 4 seconds in the case of comparative examples (a) and (i) and for a duration of 6 seconds in the case of comparative examples (ii) and (iii) and in the case of examples 1 to 10 according to the invention at the annealing temperatures T given in the table. Examples 1 to 10 in Table 1 all have a reduced Nb content of less than 2 atomic %.

In the alloy examples 1, 2 and 3, Nb is completely replaced by various Mo contents. For Mo contents from 2 atomic %, the coercitive field strength is less than 8 A/m, decreasing further with increasing Mo contents.

In the alloy examples 4 and 5, Nb is completely replaced by various Ta contents. For Ta contents around 2 atomic %, the coercitive field strength, being $H_c$=3 A/m, is comparable to the comparative examples, but magnetic saturation polarisation $J_s$ is higher.

One advantage of Ta and Mo over Nb is their better availability on the world market. Ta has the advantage of being more effective in reducing coercitive field strength, in particular compared to Mo. The high raw material costs of Ta are a disadvantage, however. In view of this, attempts were made to replace Nb only partially, if possible with Mo.

In alloy example 6, the major part of Nb was replaced by Mo and Ta. Here, too, coercitive field strength values are comparable to the comparative examples, combined with a higher magnetic saturation polarisation $J_s$.

In the alloy examples 7 to 10, Nb is partially replaced by Mo. Here, too, coercitive field strength values are markedly less than 10 A/m, if the total content of Nb and Mo is at least 1.9 atomic %. If the composition approaches the lower limit, it is advantageous if the Nb content is slightly higher than the Mo content.

Table 2 shows further alloy examples 11 and 12 and their magnetic properties after a heat treatment of 6 s under a tension of 50±10 MPa at the annealing temperature given in the table.

The magnetic properties demonstrate that the addition of Mo and Ta is possible if the Nb content is higher than 2 atomic %. Alloy example 11, for instance, indicates that even a minor addition of 0.2 atomic % Mo combined with a reduction of the Nb content by 0.3 atomic % results in a slight $H_c$ reduction compared to comparative example (a) from Table 1, the saturation polarisation $J_s$ being advantageously increased by about 15%. In alloy example 12, Nb is substituted by Ta, resulting in magnetic properties comparable to those of example (a) from Table 1, if the alloy is heat-treated using a suitable tension at a suitable annealing temperature.

Figure 2:
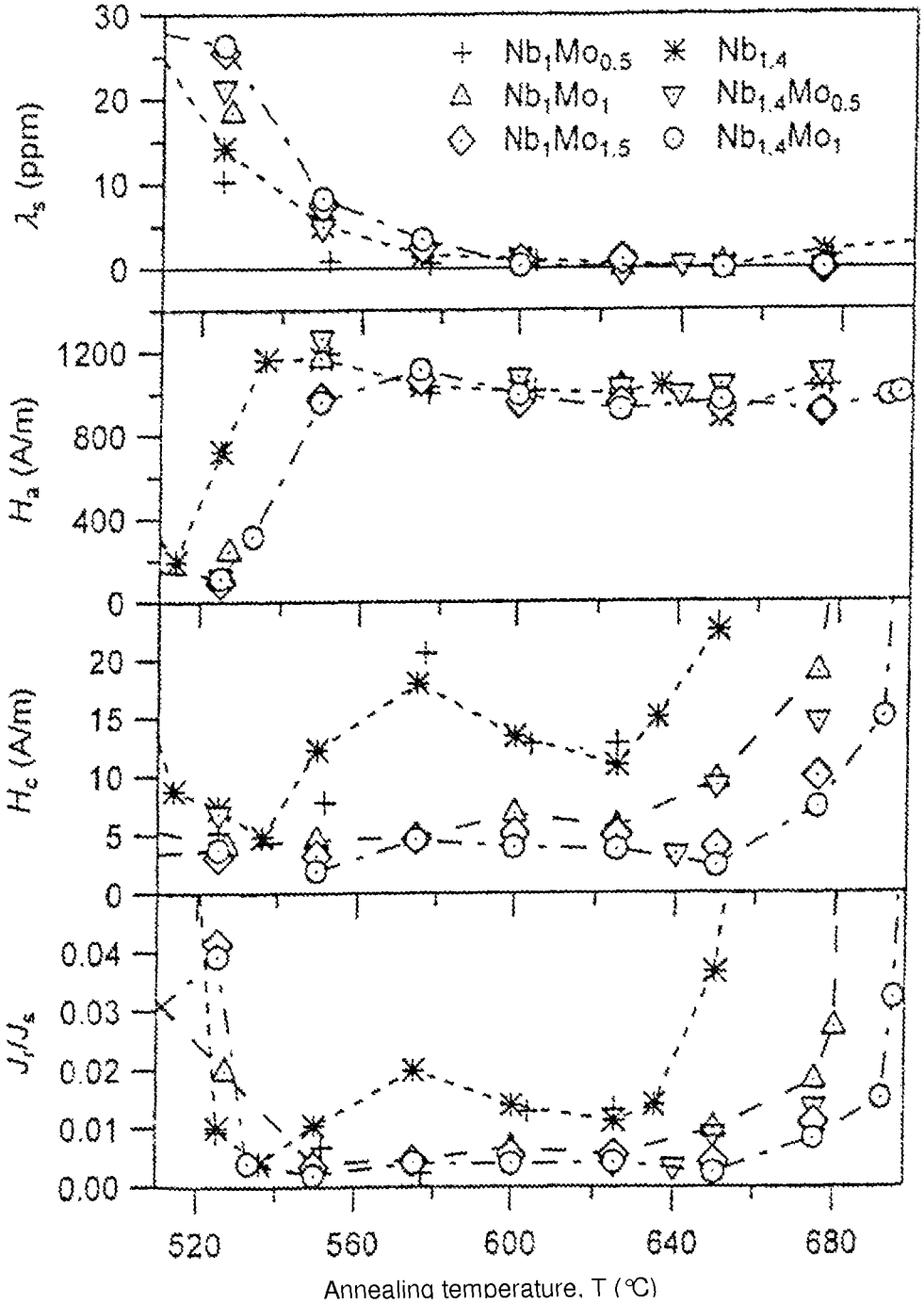
FIG. 2 shows magnetic properties for alloys according to the invention with various Nb and Mo contents, produced at different annealing temperatures.
Figure 3:
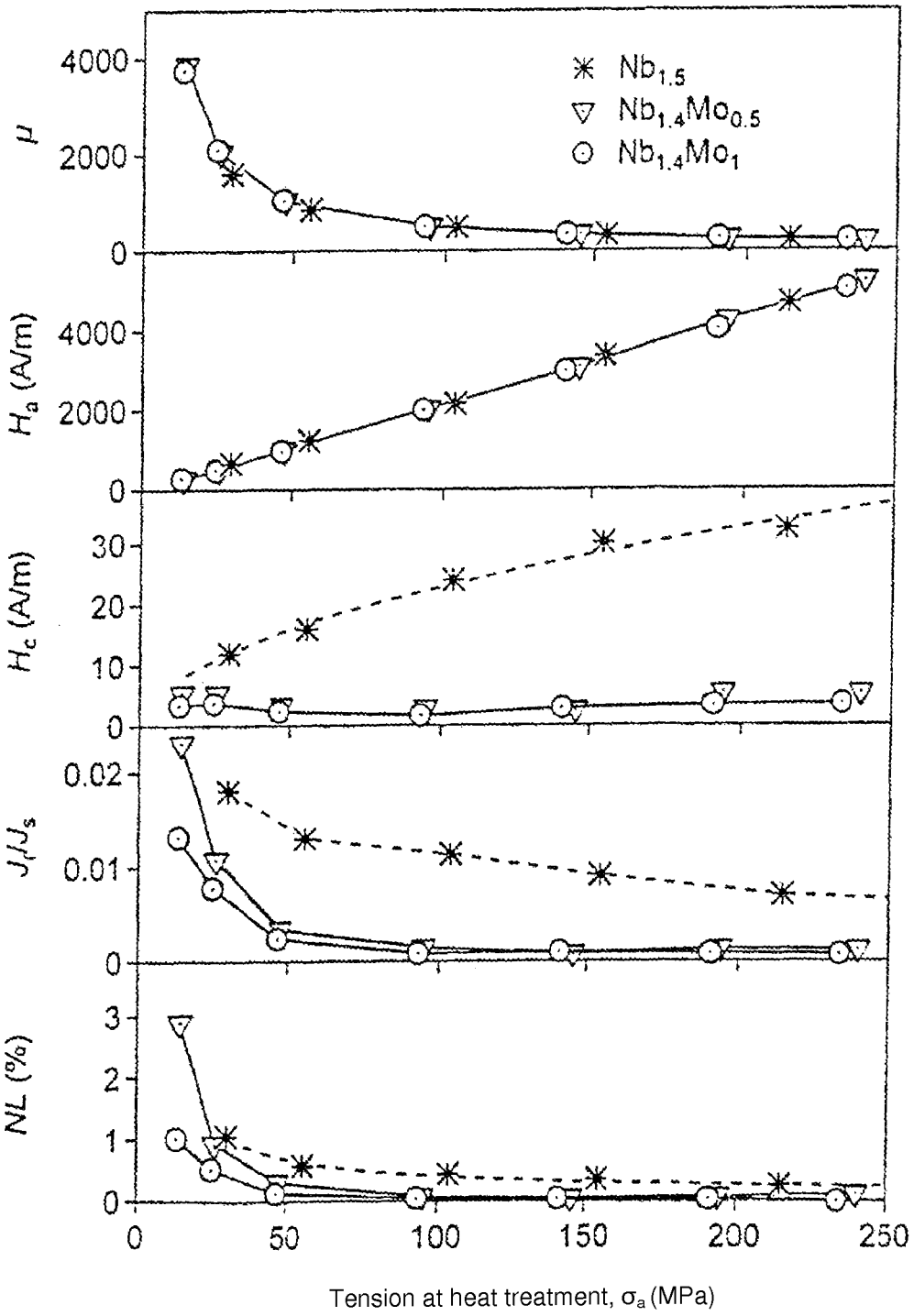
FIG. 3 shows magnetic properties for alloys produced at different tensions.

Further embodiments are disclosed in FIGS. 1, 2 and 3.

FIG. 1 shows a typical hysteresis loop which results from heat treatment under tension. FIG. 1 shows the quasi-static hysteresis loop of the alloy $Fe_{74.7}Cu_{0.8}Nb_{1.4}Mo_1Si_{15.5}B_{6.6}$ after a heat treatment of 6 s at 650° C. with two different tensions, wherein $\sigma_{a1}$~50 MPa and $\sigma_{a2}$~140 MPa.

FIG. 1 further illustrates the definition of the magnetic saturation polarisation $J_s$, of the anisotropic field strength $H_a$, of the coercitive field strength $H_c$ and of the remanent polarisation $J_r$. For an alloy according to the invention, the coercitive field strength should, at an anisotropic field strength $H_a$ of approximately 1000 A/m, be less than 10 A/m, i.e. less than approximately 1% of $H_a$. Such low values are difficult to measure at full modulation of the hysteresis loop (measuring accuracy approximately ±1/Am) and therefore hardly identifiable with the bare eye in FIG. 1. Nevertheless, if remagnetisation losses are to be minimised, it is advisable to keep to such low values.

A characteristic of the hysteresis loop is its linearity in the centre of the hysteresis loop. A measure for this is a low remanence ratio $J_r/J_s$.

FIG. 2 shows the saturation magnetostriction λs, the anisotropic field strength $H_a$, the coercitive field strength $H_c$ and the remanence ratio $J_r/J_a$ as a function of the annealing temperature T for $Fe_{77.1-x-y}Cu_{0.8}Nb_xMo_ySi_{15.5}B_{6.6}$ with two different Nb contents and increasing Mo contents after a heat treatment of approximately 6 seconds under a tension of approximately 50 MPa. The compositions involved are $Fe_{75.6}Cu_{0.8}Nb_1Mo_{0.5}Si_{15.5}B_{6.6}$, $Fe_{75.1}Cu_{0.8}Nb_1Mo_1Si_{15.5}B_{6.6}$, $Fe_{74.6}Cu_{0.8}Nb_1Mo_{1.5}Si_{15.5}B_{6.6}$, $Fe_{75.7}Cu_{0.8}Nb_{1.4}Si_{15.5}B_{6.6}$, $Fe_{75.2}Cu_{0.8}Nb_{1.4}Mo_{0.5}Si_{15.5}B_{6.6}$ and $Fe_{74.7}Cu_{0.8}Nb_{1.4}Mo_1Si_{15.5}B_{6.6}$.

The desired magnetic properties, i.e. a low saturation magnetostriction λs, a defined anisotropic field strength $H_a$, a low coercitive field strength $H_c$ and a low remanence ratio $J_r/J_s$, are obtained in a specific annealing window which is characteristic for the respective alloy and which is characterised by a minimum annealing temperature $T_1$ and a maximum annealing temperature $T_2$. This annealing range can be determined by a standard measurement of the crystallisation temperatures $T_{x1}$ and $T_{x2}$, for example by means of DSC (differential scanning calorimetry), allowing the annealing temperature T to be defined.

Table 3 shows crystallisation temperatures $T_{x1}$ and $T_{x2}$ (DSC 10 K/min, peak) and suitable annealing temperatures T for the alloy $Fe_{75.5-x}Cu_{0.8}Nb_{1.4}Mo_xSi_{15.5}B_{6.6}$ for annealing times of approximately 6 seconds. The example number corresponds to the alloy composition given in Table 1. Table 3 shows by way of example the context for the annealing time of approximately 6 seconds used here.

The results from FIG. 2 make clear that the saturation magnetostriction and the anisotropic field strength behave approximately in the same way in all examples, while there are noticeable differences in coercitive field strength and remanence ratio.

Complementing Table 1, FIG. 2 discloses that alloys with a total (Nb+Mo) content from approximately 2 atomic % (which includes 1.9 atomic %) have in a wide annealing temperature range a coercitive field strength significantly lower than 10 A/m. Alloys with a total (Nb+Mo) content>2.3 atomic % exhibit with $H_c$=5 A/m even better values within a large range, which furthermore react less sensitively to the precise annealing temperature. Compared to this, alloys with an (Nb+Mo) content typically have a coercitive field strength between 10 and 20 A/m and correspondingly high hysteresis losses. In addition, $H_c$ changes relatively markedly with the annealing temperature.

The above examples relate to a annealing tension $\sigma_a$ of approximately 50 MPa. FIG. 3 shows the effect of this annealing tension on magnetic values.

FIG. 3 shows the relative permeability the anisotropic field strength $H_a$, the coercitive field strength $H_c$, the remanence ratio $J_r/J_a$ and the nonlinearity factor of the alloys $Fe_{75.7-y}Cu_{0.8}Nb_{1.4}Mo_ySi_{15.5}B_{6.6}$ with y=0.5 atomic % and y=1 atomic % after a heat treatment of 6 seconds at 640° C. for Mo=0.5 atomic % or at 650° C. for Mo=1 atomic % compared to $Fe_{75.5}Cu_1Nb_1Si_{15.5}B_{6.5}$ at a heat treatment of 4 seconds at 610° C. as a function of the tension $\sigma_a$ applied during the heat treatment.

FIG. 3 discloses that the anisotropic field strength $H_a$ increases proportionally with the tension applied during the heat treatment, while the permeability is reduced inversely proportionally to $\sigma_a$. The annealing tension $\sigma_a$ is finally selected such that a predefined value for permeability and anisotropic field strength is set. In this respect, all of the alloy examples shown behave in a similar way, while there are noticeable differences in coercitive field strength, i.e. in hysteresis losses. The alloys according to the invention exhibit even better coercitive field strength values at increased annealing tensions. For example, while in an alloy with 1.5 atomic % Nb the coercitive field strength increases noticeably with the tension applied, an Mo addition of only 0.5 atomic % reduces the tension-dependence of $H_c$, thereby effecting an improvement. This applies correspondingly to an addition of 1 atomic %, which has even better effects. This also applies to lower annealing tensions, which are used if a lower anisotropic field strength and permeability values equal to or higher than 2000 are to be set.

Figure 4:
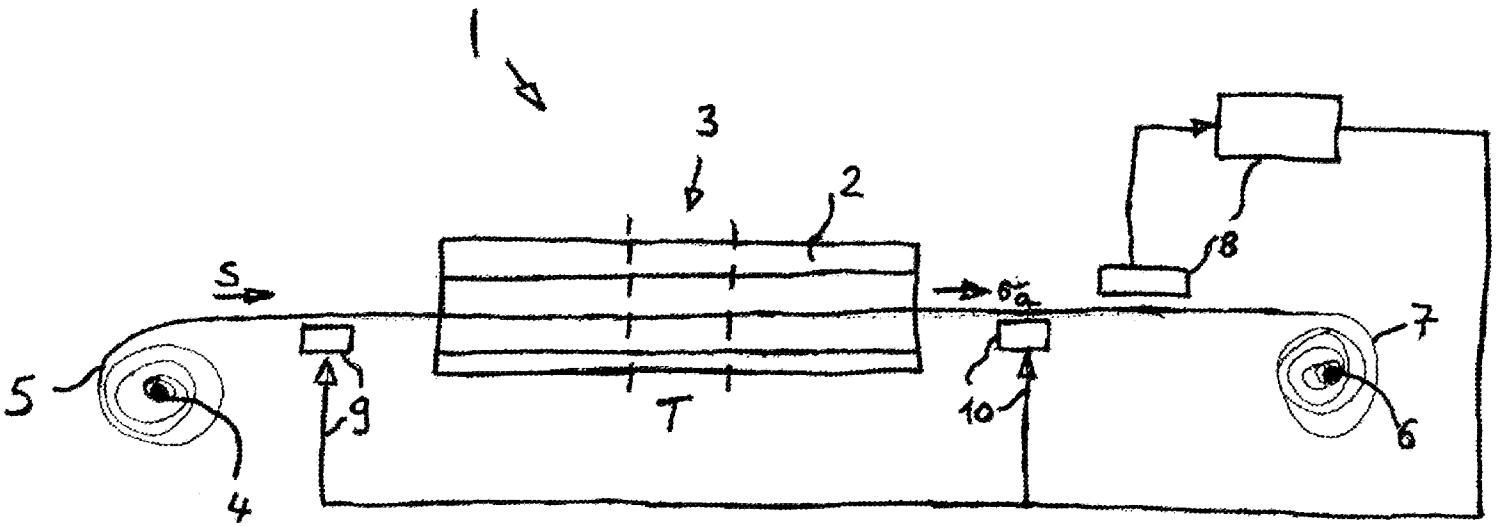
FIG. 4 is a diagrammatic view of a continuous furnace.

FIG. 4 is a diagrammatic view of an apparatus 1 suitable for producing the alloys with a composition according to any of the above embodiments in the form of a strip. The apparatus 1 comprises a continuous furnace 2 with a temperature zone 3 which is adjusted such that the temperature in the furnace within this zone is within 5° C. of the annealing temperature T. The apparatus 1 further comprises a reel 4 on which the amorphous alloy 5 is wound and a take-up reel 6 which receives the heat-treated strip 7. The strip 7 is pulled by the reel 4 through the continuous furnace 2 to the take-up reel 6 with a speed s. In this process, the strip is subjected to a tension $\sigma_a$ in the running direction from the device 9 to the device 10.

The apparatus 1 further comprises a device 8 for continuously measuring the magnetic properties of the strip 6 after it has been heat-treated and pulled out of the continuous furnace 2. In the region of this device 8, the strip 7 is no longer subjected to tension. The measured magnetic properties can be used for adjusting the tension $\sigma_a$ under which the strip 7 is pulled through the continuous furnace 2. This is indicated diagrammatically in FIG. 13 by arrows 9 and 10. By this measuring of the magnetic properties and the continuous tension adjustment, the uniformity of the magnetic properties along the length of the strip can be improved.

TABLE 1

| No. | Composition (atomic %) | $J_s$ (T) | $T_a$ (° C.) | $\lambda_s$ (ppm) | NL (%) | $J_r/J_s$ | $H_c$ (A/m) | $H_a$ (A/m) | μ |
|---|---|---|---|---|---|---|---|---|---|
| (a) | $Fe_{74}Cu_1Nb_3Si_{15.5}B_{6.5}$ | 1.21 | 690 | 0.1 | 0.3 | 0.004 | 3 | 850 | 1130 |
| (i) | $Fe_{75.5}Cu_1Nb_{1.5}Si_{15.5}B_{6.5}$ | 1.34 | 635 | 0.6 | 0.6 | 0.008 | 13 | 1180 | 890 |
| (ii) | $Fe_{75.7}Cu_{0.8}Nb_{1.4}Si_{15.5}B_{6.6}$ | 1.36 | 625 | 0.4 | 0.7 | 0.011 | 11 | 1000 | 1085 |
| (iii) | $Fe_{75.6}Cu_{0.8}Nb_1Mo_{0.5}Si_{15.5}B_{6.6}$ | 1.37 | 625 | −0.5 | 0.7 | 0.013 | 13 | 1000 | 1085 |
| 1 | $Fe_{75.1}Cu_{0.8}Mo_2Si_{15.5}B_{6.6}$ | 1.30 | 625 | 0.5 | 0.2 | 0.010 | 7 | 1170 | 880 |
| 2 | $Fe_{74.1}Cu_{0.8}Mo_3Si_{15.5}B_{6.6}$ | 1.23 | 655 | −0.06 | 0.5 | 0.006 | 6 | 1000 | 980 |
| 3 | $Fe_{73.1}Cu_{0.8}Mo_4Si_{15.5}B_{6.6}$ | 1.14 | 640 | 0.2 | 0.07 | 0.003 | 3 | 1020 | 945 |
| 4 | $Fe_{75.1}Cu_{0.8}Ta_2Si_{15.5}B_{6.6}$ | 1.31 | 640 | 0.3 | 0.10 | 0.003 | 3 | 1080 | 885 |
| 5 | $Fe_{74.1}Cu_{0.8}Ta_3Si_{15.5}B_{6.6}$ | 1.23 | 640 | 0.4 | 0.07 | 0.002 | 2 | 1010 | 950 |
| 6 | $Fe_{74.1}Cu_{0.8}Nb_1Mo_1Ta_1Si_{15.5}B_{6.6}$ | 1.24 | 640 | 0.2 | 0.09 | 0.004 | 4 | 990 | 965 |
| 7 | $Fe_{74.6}Cu_{0.8}Nb_1Mo_{1.5}Si_{15.5}B_{6.6}$ | 1.27 | 650 | 0.4 | 0.3 | 0.004 | 4 | 930 | 1095 |
| 8 | $Fe_{74.7}Cu_{0.8}Nb_{1.4}Mo_1Si_{15.5}B_{6.6}$ | 1.28 | 650 | −0.06 | 0.1 | 0.002 | 2 | 960 | 1060 |
| 9 | $Fe_{75.2}Cu_{0.8}Nb_{1.4}Mo_{0.5}Si_{15.5}B_{6.6}$ | 1.32 | 640 | 0.4 | 0.3 | 0.003 | 3 | 1000 | 1040 |
| 10 | $Fe_{75.1}Cu_{0.8}Nb_1Mo_1Si_{15.5}B_{6.6}$ | 1.31 | 625 | 0.6 | 0.3 | 0.005 | 6 | 1025 | 1020 |

(a) comparative example
(i), (ii), (iii) comparative example
(1)-(10) examples according to the invention

TABLE 2

| No. | Composition (atomic %) | $J_s$ (T) | $T_a$ (° C.) | $\lambda_s$ (ppm) | NL (%) | $J_r/J_s$ | $H_c$ (A/m) | $H_a$ (A/m) | μ |
|---|---|---|---|---|---|---|---|---|---|
| 11 | $Fe_{74.2}Cu_{0.8}Nb_{2.7}Mo_{0.2}Si_{15.5}B_{6.6}$ | 1.24 | 640 | 0.7 | 0.1 | 0.002 | 2 | 930 | 1025 |
| 12 | $Fe_{74.0}Cu_{0.8}Nb_{2.2}Ta_{0.9}Si_{15.5}B_{6.6}$ | 1.22 | 675 | −0.1 | 0.1 | 0.003 | 4 | 970 | 980 |

TABLE 3

| No. | Mo (atomic %) | $T_{x1}$ (° C.) | $T_{x1}$ (° C.) | Annealing temperature T |
|---|---|---|---|---|
| (ii) | 0 | 488 | 645 | 540° C. to 630° C. |
| 9 | 0.5 | 498 | 662 | 550° C. to 650° C. |
| 8 | 1.0 | 505 | 678 | 550° C. to 670° C. |

The invention claimed is:

1. An alloy having a composition consisting of $Fe_{100-a-b-c-d-x-y-z}Cu_aNb_bM_cT_dSi_xB_yZ_z$ and up to 1 atomic % impurities, wherein M is Mo and/or Ta, T is one or more of the elements V, Cr, Co or Ni and Z is one or more of the elements C, P or Ge, and wherein 0.0 atomic %≤a<1.5 atomic %, 0.0 atomic %≤b<3.0 atomic %, 0.2 atomic %≤c≤4.0 atomic %, 0.0 atomic %≤d<5.0 atomic %, 12.0 atomic %<x<18.0 atomic %, 5.0 atomic %<y<12.0 atomic %, 0.0 atomic %≤z<2.0 atomic % and 2.0 atomic %≤(b+c)≤4.0 atomic %, wherein the alloy is in the form of a strip, wherein the alloy comprises a nanocrystalline structure, at least 50% by volume of the grains having an average size of less than 100 nm, wherein the alloy has a remanence ratio $J_r/J_s<0.02$, $J_r$ being the remanent polarisation and $J_s$ being the saturation polarisation, wherein the alloy has a coercitive field strength $H_c$ which is less than 1% of the anisotropic field strength $H_a$, wherein the strip is heat-treated in a continuous process at a annealing temperature between 450° C. and 750° C. under a tension of 5 MPa to 1000 MPa with a dwell time of 2 seconds to 2 minutes, and wherein the remanent polarisation $J_r$, the saturation polarization $J_s$, the coercitive field strength $H_c$ and/or the anisotropic field strength $H_a$ or permittivity of the strip are continuously measured as the strip leaves a continuous furnace, and if a deviation from a permitted deviation range of the remanent polarisation $J_r$, the saturation polarization $J_s$, the coercitive field strength $H_c$, and/or the anisotropic field strength $H_a$ or permittivity is detected, the tension applied to the strip is adjusted to bring the remanent polarisation $J_r$, the saturation polarization $J_s$, the coercitive field strength $H_c$, and/or the anisotropic field strength $H_a$ or permittivity measured to be outside the permitted deviation range within the permitted deviation range.

2. The alloy according to claim 1, wherein the remanence ratio $J_r/J_s$ is <0.01.

3. The alloy according to claim 1, wherein the hysteresis loop of the alloy has a nonlinearity factor NL, NL being <0.5%, and $$NL=100/2(\delta J_{auf}+\delta J_{ab})/J_s$$

wherein $\delta J_{auf}$ is the standard deviation of the magnetic polarisation from a regression line through the ascending branch of the hysteresis loop between polarisation values of ±75% of the saturation polarisation $J_s$ and $\delta J_{ab}$ is the standard deviation of the magnetic polarisation from a regression line through the descending branch of the hysteresis loop between polarisation values of ±75% of the saturation polarisation $J_s$.

4. The alloy according to claim 1, wherein the alloy has a permeability μ between 40 and 10000.

5. The alloy according to claim 1, wherein the alloy has a saturation magnetostriction of less than 1 ppm.

6. The alloy according to claim 1, wherein the alloy has a saturation polarisation $J_s$ that is ≥1.22 T and the coercitive field strength $H_c$ is ≤8 A/m.

7. The alloy according to claim 1, wherein 0.0 atomic %≤b<2.5 atomic %.

8. The alloy according to claim 1, wherein 2.1 atomic %≤(b+c)≤3.0 atomic %.

9. The alloy according to claim 1, wherein 0.0 atomic %≤d<2.0 atomic %.

10. The alloy according to claim 1, wherein 14.0 atomic %<x<17 atomic % and 5.5 atomic %<y<8.0 atomic %.

11. The alloy according to claim 1, wherein the strip is heat-treated in the continuous process under a tension of 10 MPa to 250 MPa with a dwell time of 2 seconds to 2 minutes.

12. The alloy according to claim 1, wherein the strip is heat-treated in the continuous process under a tension of 250 MPa to 1000 MPa with a dwell time of 2 seconds to 2 minutes.

13. A magnet core made from an alloy according to claim 1.

14. The magnet core according to claim 13, having the form of a wound strip.

15. The magnet core according to claim 13, wherein the strip has an oxide layer with a thickness of <0.2 μm on its surface.

16. The magnet core according to claim 13, wherein the strip is coated with an additional insulating layer.

17. The alloy according to claim 1, wherein the minimum niobium content is 1.8 atomic % and the minimum Mo content is 0.2 atomic %.

18. The alloy according to claim 1, wherein the alloy does not contain any tantalum, except as a possible impurity.

19. The alloy according to claim 1, wherein M is Mo and 1.8 atomic %≤b<3.0 atomic %.

20. The alloy according to claim 1, wherein 0.0 atomic %<b<2.5 atomic % and 2.1 atomic %≤(b+c)<3.0 atomic %.

21. The alloy according to claim 1, wherein the alloy has a permeability μ in the range of 50 to 200.

22. The alloy according to claim 1, wherein the alloy has a coercitive field strength $H_c$ which is less than 10 A/m.

23. A method for producing a strip, comprising the following:

providing a strip from an amorphous alloy with a composition consisting of $Fe_{100a-b-c-d-x-y-z}Cu_aNb_bM_cT_dSi_xB_yZ_z$ and up to 1 atomic % impurities, wherein M is Mo and/or Ta, T is one or more of the elements V, Cr, Co or Ni and Z is one or more of the elements C, P or Ge, and wherein 0.0 atomic %≤a<1.5 atomic %, 0.0 atomic %≤b<3.0 atomic %, 0.2 atomic %≤c≤4.0 atomic %, 0.0 atomic %≤d<5.0 atomic %, 12.0 atomic %<x<18.0 atomic %, 5.0 atomic %<y<12.0 atomic %, 0.0 atomic %≤z<2.0 atomic % and 2.0 atomic %≤(b+c)≤4.0 atomic %, wherein the alloy has a remanence ratio $J_r/J_s<0.02$, $J_r$ being the remanent polarisation and $J_s$ being the saturation polarisation, and the alloy has a coercitive field strength $H_c$ which is less than 1% of the anisotropic field strength $H_a$, heat treating the strip under a tension of 5 MPa to 1000 MPa with a dwell time of 2 seconds to 2 minutes in a continuous process at an annealing temperature $T_a$, wherein 450° C.≤$T_a$≤750° C., continuously measuring the remanent polarisation $J_r$, the saturation polarization $J_s$, the coercitive field strength $H_c$ and/or the anisotropic field strength $H_a$ or permittivity of the strip as the strip leaves a continuous furnace, and if a deviation from a permitted deviation range of the remanent polarisation $J_r$, the saturation polarization $J_s$, the coercitive field strength $H_c$ and/or the anisotropic field strength $H_a$ or permittivity is detected, adjusting the tension applied to the strip to bring the remanent polarisation $J_r$, the saturation polarization $J_s$, the coercitive field strength $H_c$ and/or the anisotropic field strength $H_a$ or permittivity measured to be outside the permitted deviation range within the permitted deviation range.

24. The method according to claim 23, wherein the strip is heat-treated in the continuous furnace.

25. The method according to claim 24, wherein the strip is pulled through the continuous furnace with a speed s, so that a dwell time of the strip in a temperature zone of the continuous furnace at the temperature $T_a$ is between 2 seconds and 2 minutes.

26. The method according to claim 23, wherein the strip is heat-treated in the continuous furnace under a tension of 5 MPa to 1000 MPa.

27. The method according to claim 26, wherein the strip is heat-treated in the continuous furnace under a tension of 10 MPa to 250 MPa.

28. The method according to claim 26, wherein the strip is heat-treated in the continuous furnace under a tension of 250 MPa to 1000 MPa.

29. The method according to claim 23, further comprising: predetermining a desired value of the anisotropic field strength $H_a$ or the permeability and/or a maximum value of the remanence ratio $J_r/J_s$ of less than 0.02 and/or a maximum value of the coercitive field strength $H_c$ which is less than 1% of the anisotropic field strength $H_a$ and/or less than 10 A/m, as well as the permitted deviation range for each of these values.

* * * * *